US006735150B2

(12) United States Patent
Rothman

(10) Patent No.: US 6,735,150 B2
(45) Date of Patent: May 11, 2004

(54) METHOD OF AND APPARATUS FOR DISTINGUISHING ENGINE IDLING AND WORKING HOURS

(75) Inventor: Steven Rothman, Bolton, MA (US)

(73) Assignee: Micrologic, Inc., Westborough, MA (US)

( * ) Notice: Subject to any disclaimer, the term of this patent is extended or adjusted under 35 U.S.C. 154(b) by 203 days.

(21) Appl. No.: 10/117,548

(22) Filed: Mar. 28, 2002

(65) Prior Publication Data

US 2003/0185103 A1 Oct. 2, 2003

(51) Int. Cl.[7] ..... G04F 10/00; G04F 8/00
(52) U.S. Cl. ..... 368/5; 368/9
(58) Field of Search ..... 368/1, 5–10

(56) References Cited

U.S. PATENT DOCUMENTS

| | | | | | |
|---|---|---|---|---|---|
| 3,965,669 | A | * | 6/1976 | Larson et al. | 368/9 |
| 4,999,820 | A | * | 3/1991 | Hetzel | 368/9 |
| 5,617,373 | A | * | 4/1997 | Kawai et al. | 368/5 |
| 6,252,823 | B1 | * | 6/2001 | McDonald et al. | 368/9 |

* cited by examiner

*Primary Examiner*—Vit W. Miska
(74) *Attorney, Agent, or Firm*—Rines and Rines

(57) ABSTRACT

A novel technique for distinguishing fuel-operated engine idling and working periods by monitoring the different values of the engine alternating-current alternator frequencies for distinguishing engine idling and working, and, where desired, total engine operating run time.

9 Claims, 1 Drawing Sheet

METHOD OF AND APPARATUS FOR DISTINGUISHING ENGINE IDLING AND WORKING HOURS

FIELD

Figure 1:
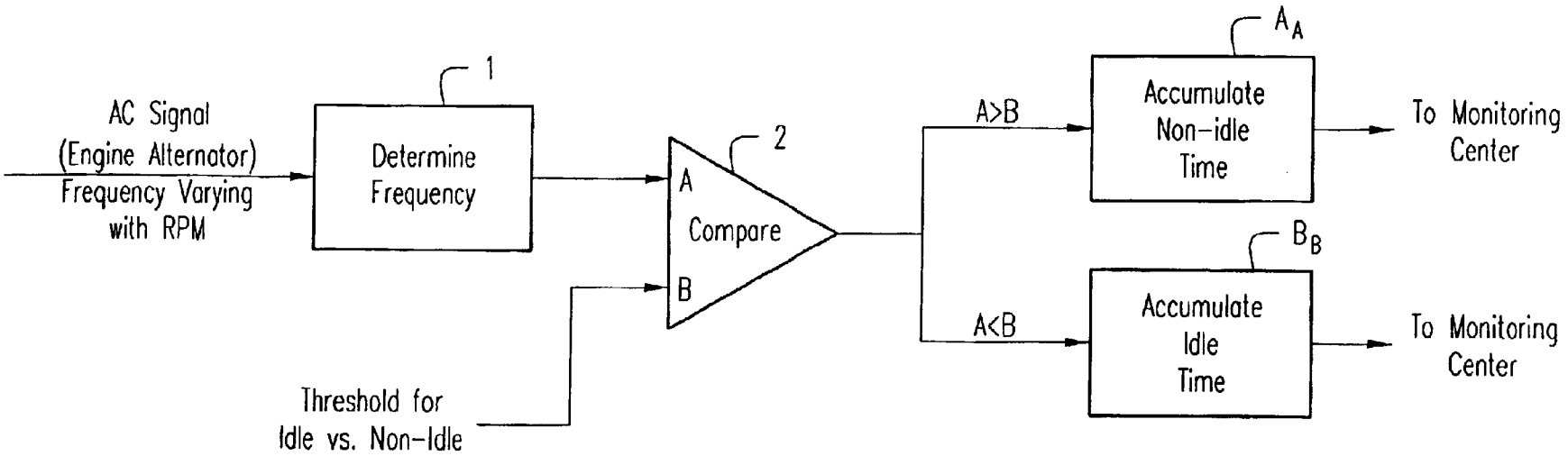

The present invention relates to the monitoring of engine working hours, such as vehicle and other fuel-driven engines, as for the purpose of monitoring the total work done by the engine, and, if desired, for scheduling maintenance and fuel delivery and for similar purposes.

BACKGROUND

Among the conditions sensed locally at vehicle engines are run hours—particularly important for monitoring the total work done by the engine, and, if desired, for scheduling fuel delivery and maintenance. Such scheduling, however, is impaired if there is no distinguishing between idling hours and working hours, including taking into account different workloads being performed that bear upon fuel consumption and engine wear and the like.

An approach to trying to ascertain these different running conditions is the monitoring of fuel consumption. Such sensing, however, is not only complex, but it is not really definitive in distinguishing information on idling vs. varying load working. This approach can thus generate an inaccurate metric of the total work done by the engine—for example, for scheduling maintenance needs.

In accordance with the present invention, on the other hand, distinguishing the conditions of the engine running idling from the engine actually working, and with different degrees of working loads, is attained through monitoring the alternating-current frequency of the engine alternator that corresponds to the engine speed (revolutions per minute). That frequency varies over time with engine operation—say, from relatively lower frequencies, say about 200–300 Hertz, or even lower frequencies, as characteristic of idling; and, above that threshold, up to higher frequencies of about 500–600 Hertz, more or less, for substantial fuel-consuming working of the engine on loads.

OBJECTS OF INVENTION

The principal object of the invention, accordingly, is to provide a new and improved method of and apparatus for differentiating and indicating engine idling periods with little fuel consumption, and periods of engine working under load and substantially consuming fuel, and that shall not be subject to the limitations of the above-described fuel-tank measurements and other prior approaches; but that, to the contrary, through monitoring the frequencies of the engine alternator corresponding to the engine speed over time, provides improved measurement of engine substantial fuel-consuming work run-hour measurements.

Other and further objects will be explained hereinafter and are more fully delineated in the appended claims.

SUMMARY

In summary, however, the invention contemplates a method of measuring fuel-operated engine running hours, that comprises, monitoring the values of the frequencies corresponding to the engine speed over time, and processing the same to distinguish frequencies representative of engine idling periods and frequencies representative of engine-working periods, thereby to enable the measurement of engine-working hours.

Preferred and best mode implementations are later detailed.

DRAWINGS

The invention will now be described in connection with the accompanying drawing the single figure of which is a block and circuit diagram showing the invention in preferred form.

PREFERRED EMBODIMENT OF THE INVENTION

Referring to the drawing, the alternating-current frequency signal of the engine alternator, as before mentioned, is of a frequency that varies with the engine speed or revolutions per minute (rpm)—ranging from the before-mentioned relatively low idling frequencies of up to about 200–300 Hertz, to higher working engine frequencies of about 600 Hertz, more or less. The alternator frequency is monitored at 1 and fed to a comparator 2 at A for comparison with a frequency at B that represents the threshold frequency selected to distinguish engine idling speeds from working speeds—say, for example, about 350 Hertz. The respective periods of time when comparator input A is greater than or less than this threshold (A>B, A<B), is processed in accumulators $A_A$ and $B_B$, respectively, thereby to provide measures of and determination and distinguishment between the working and idling hours, as for communicating to a maintenance or service center or the like.

Alternatively, instead of accumulating separately both working and idling hours, the work hour frequencies may be accumulated to $A_A$ and the total running hours of the engine operation at any and all speeds which may be monitored at a frequency common to both engine working and idling, such as about 50 Hz, may be accumulated at $B_B$, wherein the total engine run hours will equal the sum of the working and idling hours.

This methodology of distinguishing engine idling and load or work running hours is broadly applicable, including with other types of engine rpm indicators, as well. A specific important application is use in the setting of the different remote geographic locations of engine equipments such as construction equipments and the like.

Further modifications will also occur to those skilled in this art and such are considered to fall within the spirit and scope of the invention as defined in the appended claims.

What is claimed is:

1. A method of measuring fuel-operated engine running hours, that comprises, monitoring the values of the frequencies corresponding to the engine speed over time, and processing the same to distinguish frequencies representative of either the engine idling periods or of the total period of engine operation, and frequencies representative of engine-working periods, thereby to enable the measurement of engine-working hours.

2. The method of claim 1 in which the frequency monitor monitors an alternating-current alternator provided for the engine.

3. The method of claim 1 wherein the total period of engine operation is processed by monitoring a frequency common to both engine working and idling.

4. The method of claim 3 wherein said common frequency is of the order of 50 Hertz.

5. The method of claim 1 wherein the engine idling period frequencies including from about 300—300 Hertz and the engine working period frequencies include about 500–600 Hertz.

6. A method of distinguishing fuel-operated engine idling and working periods, that comprises, monitoring the different values of the frequencies corresponding to engine idling and working speeds, and distinguishing such periods by such different frequency values, and communicating the distinguishment.

7. Apparatus for measuring fuel-operated engine running hours, having, in combination, a frequency monitor for monitoring the values of frequencies corresponding to engine speed over time, and means for processing the monitored values to distinguish frequencies representative of idling periods and frequencies representative of engine-working periods, thereby to enable the determination of engine-working hours.

8. The apparatus of claim 7 in which the frequency monitor monitors an alternating-current alternator provided for the engine.

9. The apparatus of claim 7 wherein the processing means monitors a frequency common to both engine working and idling, thereby to measure the total period of engine operation, and further monitors the frequencies representative of the engine-working periods wherein the total engine run hours equals the sum of the engine working and idling periods.

* * * * *